US007824244B2

(12) United States Patent
Eisenstock et al.

(10) Patent No.: US 7,824,244 B2
(45) Date of Patent: Nov. 2, 2010

(54) METHODS AND APPARATUS FOR POLISHING A SEMICONDUCTOR WAFER

(75) Inventors: Gregory Eisenstock, Painted Post, NY (US); John Christopher Thomas, Elmira, NY (US)

(73) Assignee: Corning Incorporated, Corning, NY (US)

( * ) Notice: Subject to any disclaimer, the term of this patent is extended or adjusted under 35 U.S.C. 154(b) by 142 days.

(21) Appl. No.: 11/807,783

(22) Filed: May 30, 2007

(65) Prior Publication Data

US 2008/0299871 A1 Dec. 4, 2008

(51) Int. Cl.
*B24B 49/12* (2006.01)

(52) U.S. Cl. ..... 451/6; 451/173; 451/11

(58) Field of Classification Search ..... 451/6, 451/5, 11, 168, 173
See application file for complete search history.

(56) References Cited

U.S. PATENT DOCUMENTS 4,850,152 A * 7/1989 Heynacher et al. ..... 451/5
5,472,374 A * 12/1995 Yamada ..... 451/303
5,558,568 A * 9/1996 Talieh et al. ..... 451/303
6,325,696 B1 * 12/2001 Boggs et al. ..... 451/5
6,607,425 B1 * 8/2003 Kistler et al. ..... 451/41
6,769,970 B1 * 8/2004 Taylor et al. ..... 451/59
6,786,810 B2 * 9/2004 Muilenburg et al. ..... 451/296
6,875,085 B2 * 4/2005 Weldon et al. ..... 451/41
7,431,634 B2 * 10/2008 Lee ..... 451/11
2004/0023606 A1 2/2004 Wang et al.
2005/0054266 A1 3/2005 Togawa

OTHER PUBLICATIONS

"3M SlurryFree CMP Fixed Abrasives for Direct HDP STI CMP," JJ Gagliardi, Lead Applications Development Specialts, Technical Brief (Jul. 2003) pp. 1-8.
"Customer Specification," 3M, Nov. 23, 2004 pp. 1-4.
"3M Electonic Lapping with Trizact Diamond Tile," Indusctrial Business Electronics Markets Materials Division, No. 60-5002-0018-7 pp. 1-2.

* cited by examiner

*Primary Examiner*—Robert Rose
(74) *Attorney, Agent, or Firm*—Bruce P. Watson; Matthew Dernier

(57) ABSTRACT

Methods and apparatus provide for: a base on which a substrate may be releasably coupled; a moving belt located with respect to the base such that a contact surface thereof is operable to remove material from a top surface of the substrate; and a plurality of actuators, at least two of which are independently controllable, located with respect to the base and the moving belt such that a corresponding plurality of pressure zones are defined to provide pressure between the moving belt and the top surface of the substrate.

24 Claims, 5 Drawing Sheets

100

METHODS AND APPARATUS FOR POLISHING A SEMICONDUCTOR WAFER

BACKGROUND OF THE INVENTION

The present invention relates to methods and apparatus for polishing substrates using chemical mechanical polishing (CMP).

CMP is one accepted method of planarization (controlled polishing) of substrates used in, for example, semiconductor fabrication. The existing CMP methods typically require that the substrate be mounted on a carrier or polishing head. An exposed surface of the substrate is placed against a rotating polishing pad, which may be a standard pad or a fixed-abrasive pad. A standard pad has a durable roughened surface, whereas a fixed-abrasive pad has abrasive particles held in a containment media. The carrier head provides a controllable load, i.e., pressure, on the substrate to push it against the polishing pad. A polishing slurry, including a chemically-reactive agent (and abrasive particles if a standard pad is used) is applied to the surface of the polishing pad.

The CMP process provides a high polishing rate and a resulting substrate surface that is free from small-scale roughness and flat (lacking large-scale topography). The polishing rate, finish and flatness are determined by characteristics of the pad and slurry combination, the relative speed of the pad over the substrate, and the force pressing the substrate against the pad.

An existing rotating-belt type CMP processing apparatus 20 is illustrated in U.S. Patent Publication No. 2004/0209559, the entire disclosure of which is hereby incorporated by reference. A rectangular platen 100 includes a polishing sheet 110 that advances via rollers over a top surface 140 of the platen 100. A carrier head 80 receives a substrate 10 for polishing, and applies a downward pressure of the substrate 10 against the polishing sheet 110. A fluid may be injected between a top surface 140 of the platen 100 and the polishing sheet 110 to create a fluid bearing therebetween. In addition to the information contained in U.S. Patent Publication No. 2004/0209559, further details as to the structure of the carrier head 80 may be found in U.S. Pat. No. 6,183,354, the entire disclosure of which is hereby incorporated by reference.

An aperture or hole 154 may be formed in the top surface 140 of the platen 100 and aligned with a transparent strip 118 in the polishing sheet 110. The aperture 154 and transparent strip 118 are positioned such that they permit a "view" of the substrate 10 during a portion of the platen's rotation. An optical monitoring system 90 includes a light source 94, such as a laser, and a detector 96. The light source generates a light beam 92 which propagates through aperture 154 and transparent strip 118 to impinge upon the exposed surface of substrate 10. The apparatus 20 uses the optical monitoring system 90 to determine the thickness of the substrate 10, to determine the amount of material removed from the substrate 10, or to determine when the surface has become planarized. A computer 280 may be programmed to activate the light source 94 when the substrate 10 overlies the aperture 154, to store measurements from the detector 96, to display the measurements on an output device 98, and to detect the polishing endpoint. In addition to the information contained in U.S. Patent Publication No. 2004/0209559, further details as to the structure of the optical monitoring system 90 and computer 280 may be found in U.S. Pat. No. 5,893,796, the entire disclosure of which is hereby incorporated by reference.

One of the problems with the aforementioned rotating-belt type CMP processing apparatus is that there is not adequate control over the amount and quality of the pressure between the substrate being polished and the rotating polishing sheet. Accordingly, there are needs in the art for new methods and apparatus for polishing via CMP which result in improved substrate finishes.

SUMMARY OF THE INVENTION

In accordance with one or more embodiments of the present invention, methods and apparatus provide for: a base on which a substrate may be releasably coupled; a moving abrasive member located with respect to the base such that a contact surface thereof is operable to remove material from a top surface of the substrate; and a plurality of actuators, at least two of which are independently controllable, located with respect to the base and the moving abrasive member such that a corresponding plurality of pressure zones are defined to provide pressure between the moving abrasive member and the top surface of the substrate.

The independent control of the actuators permits conformable finishing. Indeed, in some applications, such as LCD substrate finishing, a relatively large surface area substrate may have a distortion tolerance of around 20 um, for example. A very thin layer or layers of material (on the order of a few to tens of nm in thickness) may require finishing, which layer(s) are conforming to the 20 um undulation of the substrate surface. In order to provide a precise finish on the thin layer(s), without removing the layer(s) entirely (as would occur in strict planarization), the finishing apparatus must compensate for the undulating surface of substrate while removing material from the thin layer(s).

In accordance with one or more embodiments of the present invention, methods and apparatus provide for: a base on which a substrate may be releasably coupled; a moving belt located with respect to the base such that a contact surface thereof is operable to remove material from a top surface of the substrate; and a plurality of actuators, at least two of which are independently controllable, located with respect to the base and the moving belt such that a corresponding plurality of pressure zones are defined to provide pressure between the moving belt and the top surface of the substrate.

The actuators may include at least one fluid controlled actuator operable to vary the pressure between the moving belt and the top surface of the substrate in an associated one of the pressure zones as a function of a pressure of supplied fluid thereto.

The fluid controlled actuator may include at least one chamber and at least one pad in fluid communication with the chamber and one of the moving belt and a bottom surface of the substrate such that the pad is operable to vary the pressure between the moving belt and the top surface of the substrate in the associated pressure zone as a function of the pressure of the supplied fluid to the chamber.

The fluid controlled actuator may alternatively include a plate and a plurality of bores through the plate communicating at first ends thereof with the supplied fluid and at second ends thereof with one of the moving belt and a bottom surface of the substrate such that the supplied fluid is operable to vary the pressure between the moving belt and the top surface of the substrate in the associated pressure zone as a function of the pressure of the supplied fluid within the bores.

The actuators alternatively include at least one piezoelectric actuator operable to vary the pressure between the moving belt and the top surface of the substrate in an associated one of the pressure zones as a function of an applied voltage thereto.

The methods and apparatus may further provide for at least one optical detector circuit operable to monitor a thickness of the substrate in at least one of the pressure zones. A bottom surface of the substrate opposite the top surface may be coupled to a top surface of the base; and the base may include at least one aperture extending to the top surface thereof and located in the at least one pressure zone such that the optical detector circuit is operable to monitor the thickness of the substrate via the bottom surface thereof.

The base may include a plurality of such apertures extending to the top surface thereof, at least one aperture located in each pressure zone. The optical detector circuit may include a plurality of detectors, at least one of the plurality of detectors being operable to monitor the thickness of the substrate via the bottom surface thereof through a respective one of the apertures in respective ones of the pressure zones. The optical detector circuit may be operable to move in registration with respective ones of the apertures in order to monitor the thickness of the substrate via the bottom surface thereof through in respective ones of the pressure zones.

The methods and apparatus may further provide for a processor operating under control of a program and producing at least first and second signals in response to substrate thickness information provided by the optical detector circuit, wherein each of the first and second signals is operable to control the respective pressures provided by respective ones of the plurality of actuators. The processor may be operable to compute from the thickness information at least one of: a rate at which material is removed from the substrate by the moving belt; an amount of material that has been removed from the substrate by the moving belt; and a variation in thickness of the substrate.

Other aspects, features, and advantages of the present invention will be apparent to one skilled in the art from the description herein taken in conjunction with the accompanying drawings.

DESCRIPTION OF THE DRAWINGS

For the purposes of illustration, there are forms shown in the drawings that are presently preferred, it being understood, however, that the invention is not limited to the precise arrangements and instrumentalities shown.

DETAILED DESCRIPTION OF THE PREFERRED EMBODIMENTS

Figure 1:
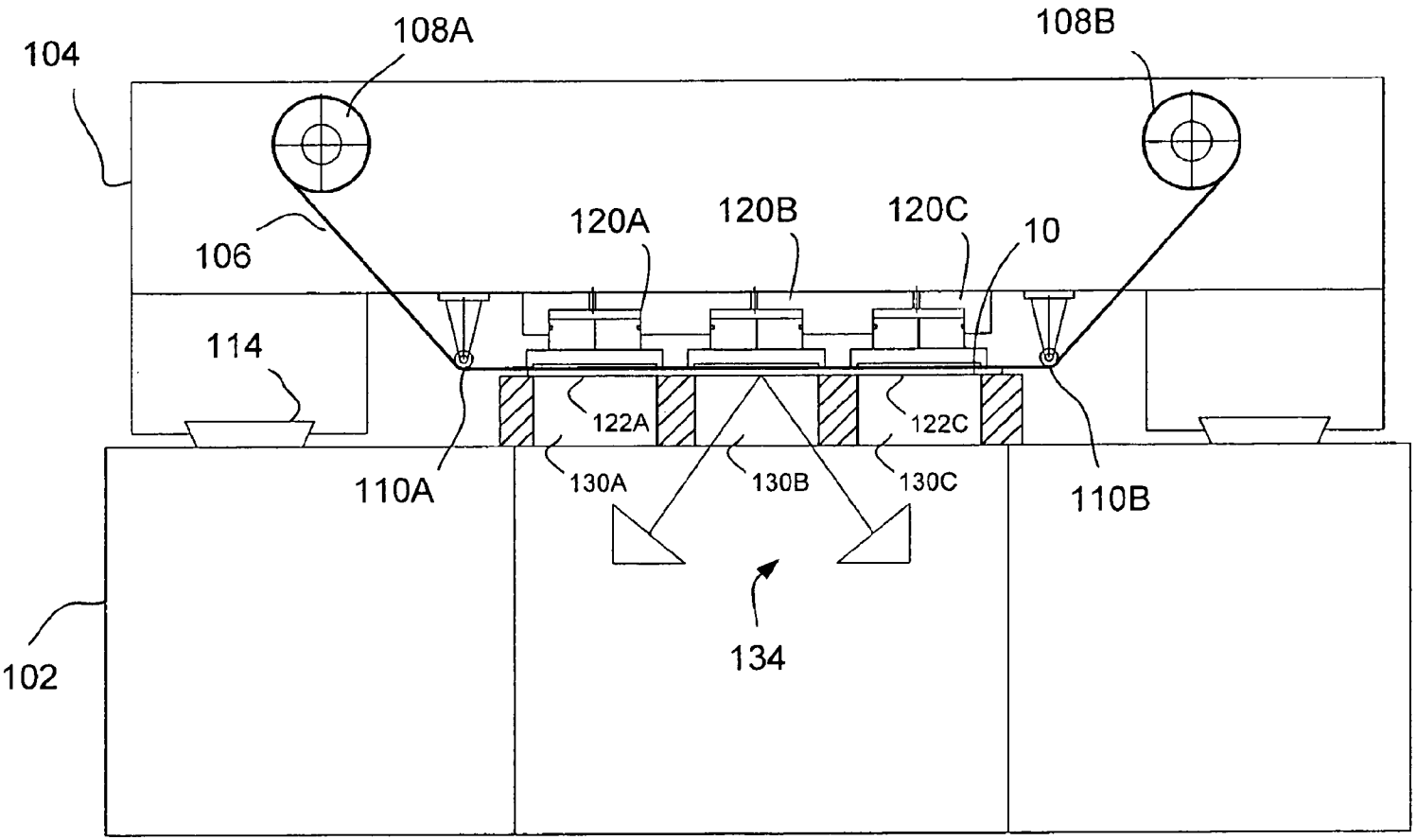
FIG. 1 is a side cross-sectional elevational view of an apparatus for polishing a substrate in accordance with one or more aspects of the present invention.

With reference to the drawings, wherein like numerals indicate like elements, there is shown in FIG. 1 a cross-sectional side view of a CMP apparatus 100 in accordance with one or more embodiments of the present invention. The CMP apparatus 100 is operable to remove material, e.g., polish, a substrate 10 in a controlled fashion to achieve a highly uniform, polished surface.

The substrate may be any material, such as glass, glass ceramic, semiconductor, and combinations of the above, such as semiconductor on insulator (SOI) structures. In the case of semiconductor materials, such may be taken from the group comprising: silicon (Si), germanium-doped silicon (SiGe), silicon carbide (SiC), germanium (Ge), gallium arsenide (GaAs), GaP, and InP.

The CMP apparatus 100 includes a base 102 and an upper structure 104 coupled thereto. The upper structure 104 includes a moving member having an abrasive contact surface that is operable to remove material from a top surface of the substrate 10. In the illustrated embodiment, the moving abrasive member is a moving belt 106 that is guided over the top surface of the substrate 10 at a controllable rate and pressure. A number of rollers, such as primary rollers 108A, 108B and secondary rollers 110A 110B are employed to drive and guide the moving belt 106 across the top surface of the substrate 10. The upper structure 104 also includes a frame or chassis that positions the rollers 108, 110, and therefore the moving belt 106, with respect to the base 102 to achieve suitable clearances and engagement of the moving belt 106 against the substrate 10. The moving belt 106 may exhibit both rotational movement (e.g., via rollers 108, 110), as well as translational movement as will be discussed further below.

The upper structure 104 includes a plurality of actuators 120 that operate to urge the moving belt 106 against the top surface of the substrate 10 in order to create a suitable amount of pressure therebetween. At least two, and preferably all, of the actuators 120 are independently controllable such that respective pressure zones 122A, 122B, 122C . . . are defined at the top surface of the substrate 10. Consequently, independent control of each actuator 120 results in the same or different pressures at the respective pressure zones 122, thereby enabling variability in the applied pressure between the moving belt 106 and the substrate 10 as well as variability in the location of such pressure.

The base 102 may include a plurality of apertures 130A, 130B, 130C . . . extending to a top surface of the base 102. At least one aperture 130 is located in each pressure zone 122 so that a bottom surface of the substrate 10 may be viewed through such aperture 130. The CMP apparatus 100 also includes at least one optical detector circuit 132 (FIG. 2) that is operable to monitor a thickness of the substrate 10 in at least one of the pressure zones 122 through the associated aperture 130. The optical detector circuit 132 may include a plurality of optical detectors 134A, 134B, 134C . . . , where at least one (and preferable each) of the optical detectors 134 are operable to monitor the thickness of the substrate 10 via the bottom surface of the substrate 10 through respective apertures 130. In other words, the optical detectors 134 are operable to sense the thickness of the substrate 10 by inducing light through the substrate 10 from below the bottom surface thereof. The optical detector(s) 134 may be implemented using known interferometer technologies. The optical detector(s) 134 may include a light source, such as a laser, and a detector. The light source generates a light beam which propagates through aperture 130 to impinge upon the exposed bottom surface of the substrate 10.

In an alternative embodiment, the optical detector circuit may include a single optical detector 134 that is operable to move in registration with respective ones of the apertures 130A, 130B, 130C . . . in order to monitor the thickness of the substrate 10 at each one of the pressure zones 122. Irrespective of the particular implementation of the optical detector circuit 132, the combination of the plurality of actuators 120 and optical detection results is highly regulated control of the pressures in the respective pressure zones 122 as well as corresponding monitoring of the removal of material from the substrate 10.

Figure 2:
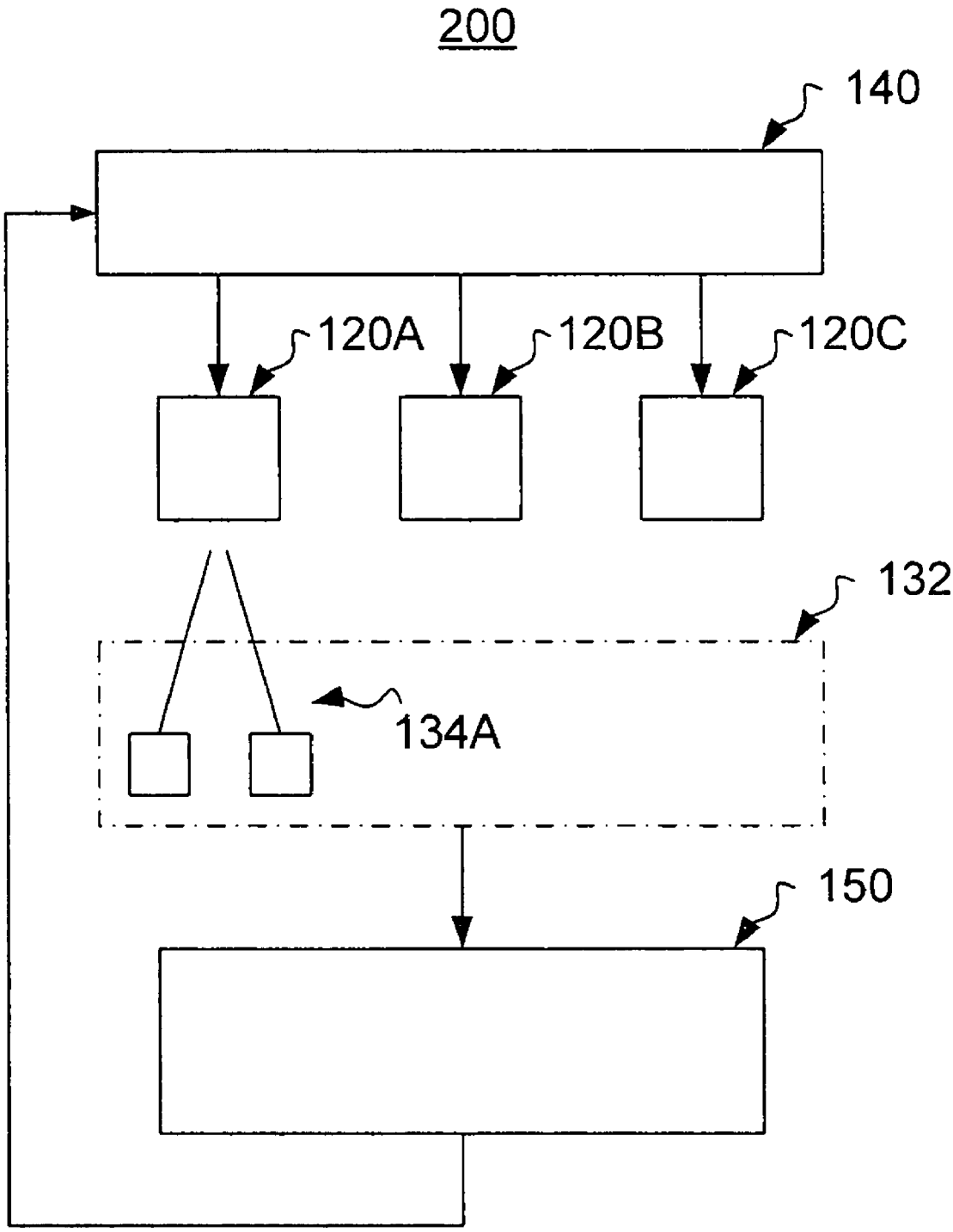
FIG. 2 is block diagram of a closed-loop control circuit suitable for use with the apparatus of FIG. 1.

With reference to FIG. 2, a schematic diagram is shown of a closed-loop control system 200 suitable for use in combination with the CMP apparatus 100. The control system 200 includes the actuators 120, the optical detector circuit 132, an energy source circuit 140, and a processor circuit 150. As discussed above, the actuators 120 are operable to urge the moving belt 106 against the top surface of the substrate 10 at respective pressure zones 122. The actuators 120 receive input from the energy source circuit 140 such that each actuator 120A, 120B, 120C . . . is capable of independent actuation and resultant pressure. The optical detector circuit 132 monitors the thickness of the substrate 10 in each of the pressure zones 122 and provides such thickness information to the processor circuit 150. The processor circuit 150 receives the substrate thickness information and utilizes same to provide controlled signaling to the energy source circuit 140. The processor circuit 150 may be implemented utilizing any of the known micro-processor chip sets that operate under the control of a software program.

By way of example, the processor circuit 150 may utilize the substrate thickness information to compute a rate at which material is removed from the substrate 10, and aggregate amount of material that has been removed from the substrate 10, a variation of the thickness of the substrate 10 from zone-to-zone, etc. The processor circuit 150 utilizes the substrate thickness information, and/or the computational results thereof, to produce one or more control signals to the energy source circuit 140 such that variable amounts of energy may be provided to the actuators 120 in order to achieve desirable pressures at the respective pressure zones 122. In this way, highly regulated control of the removal of the material from the top surface of the substrate 10 may be achieved.

Referring to FIG. 1, the upper structure 104 is operable to move (or slide) perpendicularly with respect to the direction of the moving belt 106. In the illustrated embodiment, the upper structure 104 is operable to move in a direction corresponding to movement into and out of the page via slides 114. The sliding action of the upper structure 104 via the slides 114 avoids directional marking that might otherwise occur from the moving belt 106. For example, the speed and movement characteristics of the rollers 108, 110 and the slides may be controlled such that desirable movement of the belt 106 with respect to the substrate may be achieved. The motion pattern may be simple or complex, such as circular patterns, sinusoidal patters, etc.

Figure 3A:
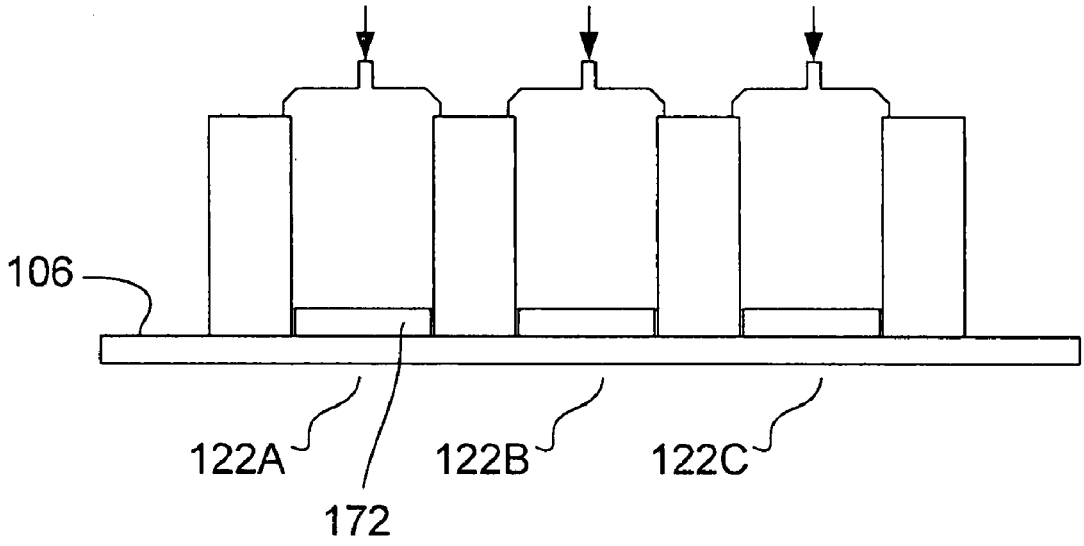
FIGS. 3A, 3B, and 4-5 are alternative implementations for the actuators used in the apparatus of FIG. 1 to apply pressure to the substrate.
Figure 3B:
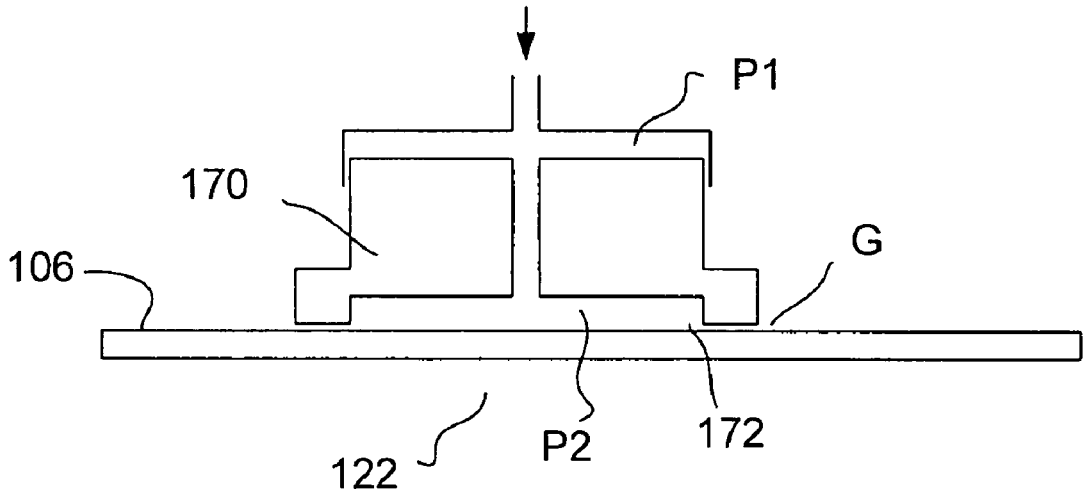
Figure 4:
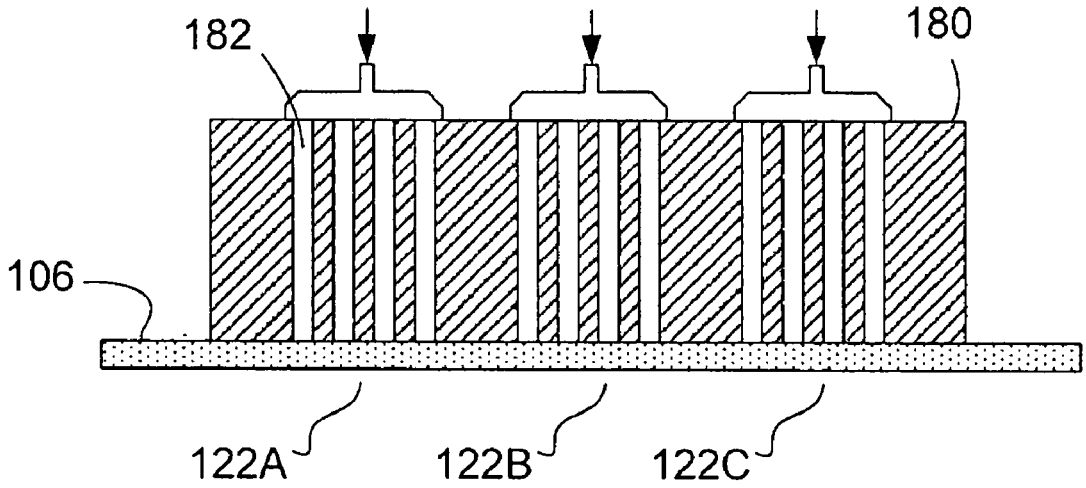
Figure 5:
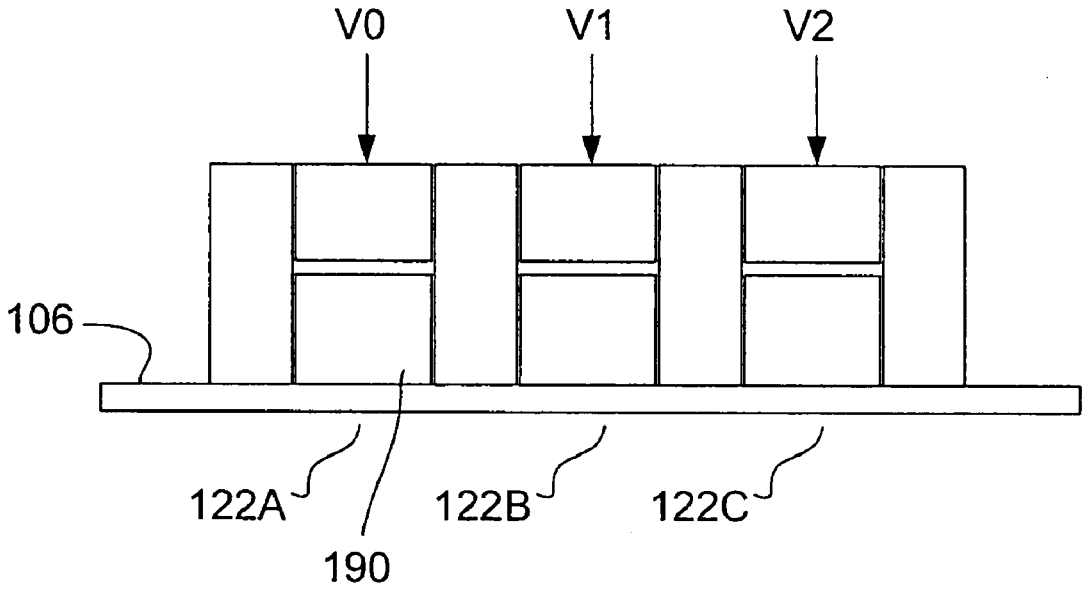

Reference is now made to FIGS. 3-5, which are simplified cross-sectional views of various embodiments suitable for implementing the actuators 120. FIG. 3A shows that the actuators 120 may be fluid controlled, whereby an increase in the supplied fluid pressure results in an increase in the pressure of the moving belt 106 against the substrate 10 in the associated pressure zone 122. Each actuator 120 includes at least one movable pad 172 such that an increase in the pressure of the fluid within the actuator 120 results in a biasing of the pad 172 toward an inside surface of the moving belt 106 (opposite to the contact surface). A lubricating fluid may be provided between the pad 172 and the inside surface of the moving belt 106 in order to reduce friction therebetween.

FIG. 3B illustrates an alternative embodiment in which the actuators 120 are implemented using self-compensating hydrostatic pads (one such actuator being shown for simplicity). The actuator 120 includes a movable member 170 situated between pressure zones P1 and P2. An orifice extends between the pressure zones P1, P2, which acts to equalize the pressures therebetween. The pressurized fluid in pressure zone P2 acts as a hydrostatic pad 172 for biasing the belt 106 against the substrate 10. Fluid escapes through the gap G, but is self-regulated, in order to ensure a programmed pressure is achieved at the hydrostatic pad 172. Specifically, if the gap G is too large (resulting in excessive leakage), the pressure at P2 drops below the pressure at P1. This pressure imbalance causes the moving member 170 to advance toward the belt 106, thereby closing the gap G and equalizing the pressure at P1 and P2.

FIG. 4 illustrates an alternative embodiment in which the actuators 120 are implemented by way of a plate 180 that includes a plurality of bores 182 therethrough, where respective groups of bores are located in the respective pressure zones 122. First ends of the bores 182 communicate with a fluid supply and second ends of the bores 182 communicate with the inside surface of the moving belt 106. Thus, an increase or decrease in the pressure of the supplied fluid through the bores 182 results in a corresponding increase or decrease in the pressure of the moving belt 106 at the pressure zone 122.

FIG. 5 illustrates a further alternative embodiment in which the respective actuators 120 are implemented utilizing piezoelectric actuators 190. Variation in the voltage supplied to the respective piezoelectric actuators 190 results in a corresponding variation in the pressure of the moving belt 106 against the substrate 10. Piezoelectric actuators 190 suitable for use in connection with the embodiments herein may be obtained from Physik Instrumente L.P., Auburn, Mass.

It is noted that, in the illustrated embodiments, the actuators 120 are positioned to engage the inside surface of the moving belt 106 in order to provide pressure thereto. In alternative embodiments, the actuators 120 may be located such that they urge the substrate against the moving belt 106. In such embodiments, however, the optical detector circuitry 132 would need to be relocated opposite to the actuators 120 and means provided to permit the optical detection of the thickness of the substrate 10 through the moving belt 106.

Figure 6:
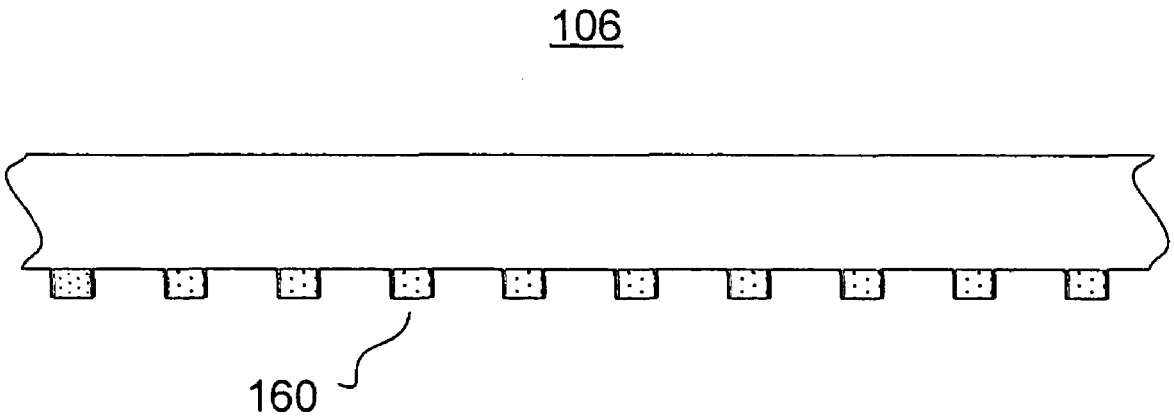
FIG. 6 is a cross-sectional view of an abrasive member suitable for use with the apparatus of FIG. 1.

With reference to FIG. 6, at least a portion of the moving belt 106 includes a fixed abrasive structure, which is a micro-replicated pattern of micron-sized posts 160 on the contact surface thereof. The posts 160 contain an abrasive material in a resin-like matrix. The fixed abrasive materials may be obtained from the 3M Company, St. Paul, Minn. Such an embodiment is believed to be advantageous when polishing silicon on glass (SiOG) substrates. Using conventional polishing techniques, the abrasive particles reach the exposed surface of the substrate under treatment, and removal of material occurs both on elevated and lower areas of the abrasive material. In the case of fixed abrasive polishing using the micro-replicated pattern of micron-sized posts 160, the abrasive particles are bound in the elevated posts 160 of the pad. Thus removal of material occurs mainly at the elevated areas of the exposed posts 160. Thus, the material removal rate, expressed as a ratio of removal between topographically higher versus lower areas of the substrate 10, is much higher than in the case of conventional techniques, such as slurry-based CMP.

Advantages of one or more embodiments of the present invention include application in sub-aperture finishing and full aperture finishing. Sub-aperture finishing may be defined as a context in which the available finishing surface of the abrasive member is smaller than the object (e.g., substrate) being finished. Thus, in sub-aperture finishing, there must be some movement (e.g., raster pattern) of the available finishing surface over the substrate to finish the desired surface area of the substrate. Full-aperture finishing may be defined as a context in which the available finishing surface of the abrasive member is larger than the substrate being finished. The independently controllable actuators and resultant independent control zones permit conformable finishing as opposed to strict planarization (although planarization may also be achieved). Additionally, compensation in tolerances of the finishing apparatus due to temperature and structural deformation may be achieved, such that highly precise finishing results.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. An apparatus, comprising:

a base on which a substrate may be releasably coupled;

a moving abrasive member located with respect to the base such that a contact surface thereof is operable to remove material from a top surface of the substrate; and a plurality of actuators, at least two of which are independently controllable, and at least one of the plurality of actuators is a fluid controlled actuator, located with respect to the base and the moving abrasive member such that a corresponding plurality of pressure zones are defined to provide pressure between the moving abrasive member and the top surface of the substrate, wherein the at least one fluid controlled actuator includes a self compensating hydrostatic pad defined by a volume of relatively higher pressure fluid in communication with one of the moving abrasive member and a bottom surface of the substrate such that the hydrostatic pad is operable to vary the pressure between the moving abrasive member and the top surface of the substrate in the associated pressure zone.

2. The apparatus of claim 1, wherein the actuators include at least one fluid controlled actuator operable to vary the pressure between the moving abrasive member and the top surface of the substrate in an associated one of the pressure zones as a function of a pressure of supplied fluid thereto.

3. The apparatus of claim 1, wherein the hydrostatic pad is directly or indirectly engageable with a surface of the moving abrasive member opposite the contact surface such that the hydrostatic pad is operable to urge the moving abrasive member against the top surface of the substrate as a function of the pressure of the supplied fluid.

4. The apparatus of claim 2, wherein at least one of the fluid controlled actuators includes a plate and a plurality of bores through the plate communicating at first ends thereof with the supplied fluid and at second ends thereof with one of the moving abrasive member and a bottom surface of the substrate such that the supplied fluid is operable to vary the pressure between the moving abrasive member and the top surface of the substrate in the associated pressure zone as a function of the pressure of the supplied fluid within the bores.

5. The apparatus of claim 4, wherein the second ends of the bores are in communication with a surface of the moving abrasive member opposite the contact surface such that the supplied fluid is operable to urge the moving abrasive member against the top surface of the substrate as a function of the pressure of the supplied fluid.

6. The apparatus of claim 1, wherein the moving abrasive member comprises a moving belt.

7. The apparatus of claim 1, further comprising at least one optical detector circuit operable to monitor a thickness of the substrate in at least one of the pressure zones.

8. The apparatus of claim 7, wherein:

a bottom surface of the substrate opposite the top surface is coupled to a top surface of the base; and the base includes at least one aperture extending to the top surface thereof and located in the at least one pressure zone such that the optical detector circuit is operable to monitor the thickness of the substrate via the bottom surface thereof.

9. The apparatus of claim 8, wherein the base includes a plurality of apertures extending to the top surface thereof, at least one aperture located in each pressure zone.

10. The apparatus of claim 9, wherein the optical detector circuit includes a plurality of detectors, at least one of the plurality of detectors being operable to monitor the thickness of the substrate via the bottom surface thereof through a respective one of the apertures in respective ones of the pressure zones.

11. The apparatus of claim 9, wherein the optical detector circuit is operable to move in registration with respective ones of the apertures in order to monitor the thickness of the substrate via the bottom surface thereof through in respective ones of the pressure zones.

12. The apparatus of claim 7, further comprising a processor operating under control of a program and producing at least first and second signals in response to substrate thickness information provided by the optical detector circuit, wherein each of the first and second signals is operable to control the respective pressures provided by respective ones of the plurality of actuators.

13. The apparatus of claim 12, wherein the processor is operable to compute from the thickness information at least one of: a rate at which material is removed from the substrate by the moving abrasive member; an amount of material that has been removed from the substrate by the moving abrasive member; and a variation in thickness of the substrate.

14. The apparatus of claim 6, wherein the moving belt includes a micro-replicated pattern of micron-sized posts on the contact surface thereof.

15. The apparatus of claim 1, wherein relative sizes of the contact surface and the top surface of the substrate are such that sub-aperture finishing is achieved.

16. A method, comprising:

removing material from a top surface of a substrate using a moving abrasive member; and adjusting respective pressures of the movable abrasive member against the top surface of the substrate in corresponding pressure zones, wherein adjusting the respective pressures is achieved by a self compensating hydrostatic pad defined by a volume of relatively higher pressure fluid in communication with one of the moving abrasive member and a bottom surface of the substrate such that the pad is operable to vary the pressure between the moving abrasive member and the top surface of the substrate in the associated pressure zone.

17. The method of claim 16, further comprising optically sensing one or more thicknesses of the substrate and adjusting the respective pressures in response thereto.

18. The method of claim 17, further comprising optically sensing thicknesses of the substrate in at least two of the pressure zones and adjusting one or more of the respective pressures in response thereto.

19. The method of claim 17, further comprising computing from the one or more thicknesses at least one of: a rate at which material is removed from the substrate; an amount of material that has been removed from the substrate; and a variation in thickness of the substrate.

20. The apparatus of claim 1, wherein the self compensating hydrostatic pad includes a movable member situated between first and second pressure zones, the second pressure zone including the volume of fluid, comprising the hydrostatic pad, in communication with one of the moving abrasive member and a bottom surface of the substrate.

21. The apparatus of claim 20, wherein the self compensating hydrostatic pad includes at least one orifice extending between the first and second pressure zones to permit fluid to flow from the first pressure zone to the second pressure zone.

22. The apparatus of claim 20, wherein the at least one orifice extends through the movable member from the first pressure zone to the second pressure zone.

23. The apparatus of claim 20, wherein the movable member is spaced away from the one of the moving abrasive member and the bottom surface of the substrate, thereby forming a gap therebetween through which the fluid flows from the second pressure zone.

24. The apparatus of claim 23, wherein:

the gap varies as the spacing between the movable member and the one of the moving abrasive member and the bottom surface of the substrate varies; and the pressure in the second pressure zone decreases below the pressure in the first pressure zone as the gap increases, and the pressure difference causes the moving member to advance and reduce the gap and equalize the pressure between the first and second pressure zones, such that the hydrostatic pad is self compensating and operates to vary the pressure between the moving abrasive member and the top surface of the substrate in the associated pressure zone.

* * * * *